US007938458B1

(12) United States Patent
Zweibohmer et al.

(10) Patent No.: US 7,938,458 B1
(45) Date of Patent: May 10, 2011

(54) ALIGNMENT ASSEMBLY FOR DOOR LATCH AND STRIKER BOLT

(75) Inventors: Dennis J. Zweibohmer, Ionia, IA (US); Brandon L. Hemann, New Hampton, IA (US)

(73) Assignee: Trimark Corporation, New Hampton, IA (US)

( * ) Notice: Subject to any disclaimer, the term of this patent is extended or adjusted under 35 U.S.C. 154(b) by 77 days.

(21) Appl. No.: 11/859,216

(22) Filed: Sep. 21, 2007

(51) Int. Cl.
*E05C 3/06* (2006.01)

(52) U.S. Cl. ..... 292/197; 292/DIG. 60; 292/341.13; 292/341.17; 292/341.18

(58) Field of Classification Search ..... 292/197, 292/340, 341.15, 341.13, 341.17, 341.18, 292/341.19, DIG. 60, DIG. 39
See application file for complete search history.

(56) References Cited

U.S. PATENT DOCUMENTS

| | | | | |
|---|---|---|---|---|
| 489,220 | A * | 1/1893 | Currier | 292/1 |
| 1,110,368 | A * | 9/1914 | Young | 292/18 |
| 1,437,635 | A * | 12/1922 | Damiani | 16/86 A |
| 1,990,141 | A * | 2/1935 | Seitz | 16/85 |
| 4,896,906 | A * | 1/1990 | Weinerman et al. | 292/48 |
| D319,001 | S | 8/1991 | Weinerman et al. | |
| 5,595,409 | A * | 1/1997 | Fier et al. | 292/112 |
| 6,039,364 | A * | 3/2000 | Rieger et al. | 292/300 |
| 6,364,380 | B2 * | 4/2002 | Franz | 292/219 |
| 6,390,520 | B1 * | 5/2002 | Holzer | 292/341.17 |
| 6,695,361 | B1 | 2/2004 | Gleason et al. | |
| 6,942,259 | B2 | 9/2005 | Marzolf et al. | |
| 6,966,585 | B2 * | 11/2005 | Egi et al. | 292/341 |
| 7,029,043 | B2 * | 4/2006 | Fisher | 292/341.13 |
| 7,156,430 | B2 | 1/2007 | Hidding et al. | |
| 2006/0006667 | A1 | 1/2006 | Hidding et al. | |

OTHER PUBLICATIONS

TriMark Brochure, 050-0200 Slimline Rotary Latch, 3 pages, 08/07-6.
TriMark Brochure, 050-0400 Floating Striker Single Rotor Latch, 2 pages, 06/06-3.
TriMark Brochure, 050-0500 Single Rotor Mini-Latch, 2 pages, 02/07-5.
TriMark Brochure, 050-0600 Single rotor Compartment Latch, 3 pages, 07/06-4.
TriMark Brochure, 050-0700 12mm Single Rotor Latch, 2 pages, 10/06-5.
TriMark Brochure, 050-0710 Direct Push Button / Remote Inside Release, 1 page.
TriMark Brochure, 050-0750 Remote Exterior / On-Latch Inside Release Lever, 1 page.
TriMark Brochure, 050-0760 Remote Exterior / Remote Inside Release, 1 page.
TriMark Brochure, 050-0810 Single Rotor Latch/Logic, 3 pages, 03/07-3.
Eberhard, Vision Style Catalog-109 dated 2004, 4 pages.

* cited by examiner

*Primary Examiner* — Carlos Lugo
*Assistant Examiner* — Mark Williams
(74) *Attorney, Agent, or Firm* — McKee, Voorhees & Sease, P.L.C.

(57) ABSTRACT

A door latch and striker combination for a vehicle door is provided with a pivotal cam on the striker assembly of the door frame so as to overcome misalignment between the latch assembly and striker assembly. When the door is moved from an open position to the closed position, the latch housing engages the cam, which pivots over center as the door closure continues, thereby lifting the latch assembly and door into proper alignment with the striker bolt on the door frame, such that the door can be closed. The cam is spring biased to an initial position with an inclined upper surface. The cam supports the latch assembly while the door is closed, and allows the latch assembly to slide over the upper cam surface when the door is opened.

11 Claims, 4 Drawing Sheets

ALIGNMENT ASSEMBLY FOR DOOR LATCH AND STRIKER BOLT

BACKGROUND OF THE INVENTION

Motor vehicles, such as automobiles and trucks, include one or more doors pivotally mounted by hinges to a door frame for movement between open and closed positions. The weight of the door is supported by the hinges. The door typically includes a latch assembly and the door frame includes a striker assembly. A rotor and catch on the latch assembly releasably mate with a bolt on the striker assembly when the door is closed.

Problems arise in closing the door when the latch assembly and striker assembly are misaligned. Such misalignment can result from damage to the door or merely from the weight of the door, particularly in military and armored vehicles which have heavy doors. Flexing of the vehicle cab and body may also lead to misalignment of the latch and striker assemblies. When the rotor of the latch assembly is misaligned or offset from the striker bolt, closing of the door becomes difficult, if not impossible. Misalignment may also detrimentally affect opening of the door.

It has been known in the prior art to utilize an inclined plane on the striker assembly to lift a door that has dropped out of alignment with the striker bolt. However, such inclined planes provide nominal lift or travel of the misaligned door, and therefore are limited to minor misalignments, typically 6 millimeters or less. Such inclined planes also require substantial force in closing the door, with such forces being detrimentally transmitted to other vehicle components.

Therefore, a primary objective of the present invention is the provision of an alignment assembly for a vehicle door latch and striker bolt.

A further objective of the present invention is the provision of an improved latch and striker combination for a vehicle door to allow the door to close even though there is misalignment between the latch and striker assemblies.

Another objective of the present invention is the provision of an alignment device for a vehicle door latch and striker combination which automatically lifts a sagging door for proper alignment during closing.

Another objective of the present invention is the provision of an alignment device for a vehicle door latch and striker combination which assists in the support of a heavy door.

Still another objective of the present invention is the provision of a vehicle door frame having a pivoting cam on a striker assembly to assure proper alignment between the rotor of a door latch and a bolt of a striker on a motor vehicle.

Yet another objective of the present invention is the provision of a method of aligning a vehicle door latch with a striker bolt on the vehicle frame.

Another objective of the present invention is the provision of a device that can be retrofit onto a vehicle door frame to align the door latch with the striker bolt.

Another objective of the present invention is the provision for a replaceable striker alignment block for field repair.

A further objective of the present invention is the provision of an alignment assembly for a vehicle door which is economical to manufacture and durable in use.

These and other objectives will become apparent from the following description of the invention.

BRIEF SUMMARY OF THE INVENTION

The alignment device or assembly of the present invention is intended for use on a vehicle door frame so as to automatically lift a misaligned door for proper closure and latching between the rotor and striker bolt. The assembly includes a cam pivotally mounted on the striker assembly on the door frame. The latch assembly on the door engages the cam before the latch rotor engages the striker bolt, so as to lift the door and the latch assembly for proper alignment of the rotor with the bolt when the door is being closed. The cam supports the latch assembly when the door is closed. The cam also facilitates easier opening of the door. The cam is spring biased so as to be pivotal between first and second positions when the door is opened and closed.

DETAILED DESCRIPTION OF THE PREFERRED EMBODIMENT

Figure 1:
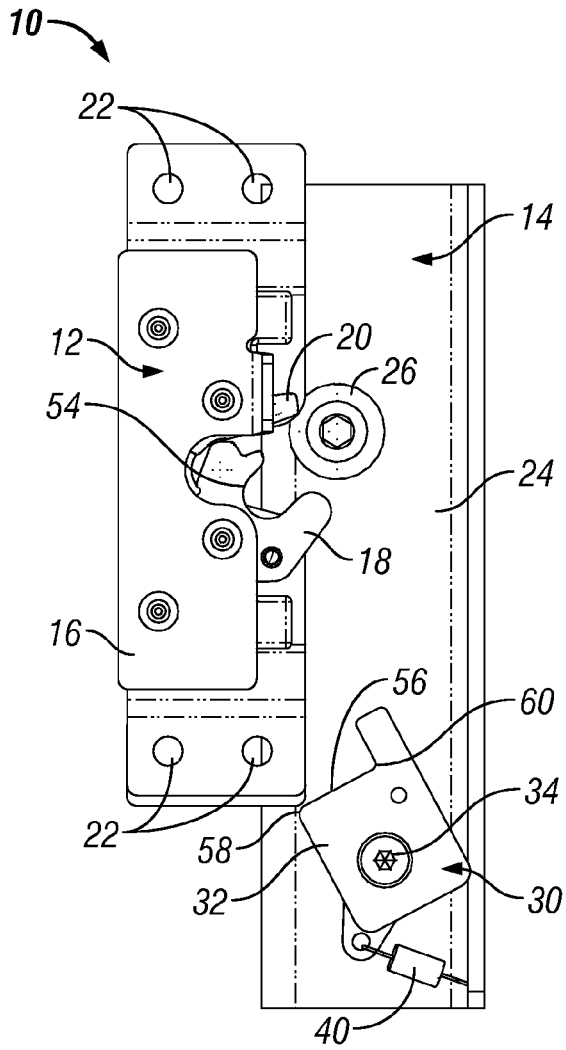
FIG. 1 is an elevation view showing a door latch assembly misaligned relative to a door frame striker assembly on a motor vehicle.

A vehicle door latch and striker combination is generally designated in the drawings by the reference numeral 10. The combination 10 includes a latch assembly 12 and a striker assembly 14. The latch assembly 12 is mounted on the vehicle door, while the striker assembly is mounted on the door frame of the vehicle.

Figure 2:
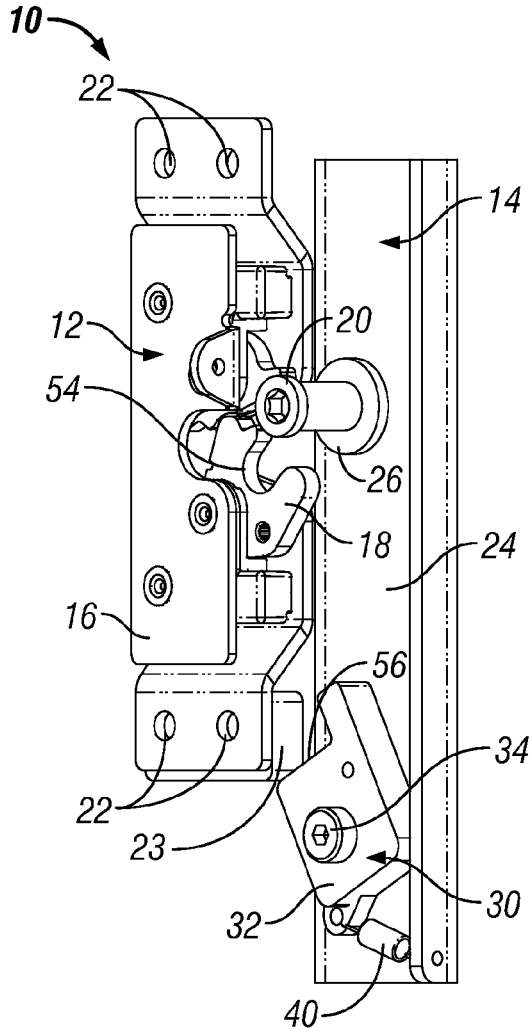
FIG. 2 is a perspective view of the misaligned latch and striker assemblies shown in FIG. 1.
Figure 4:
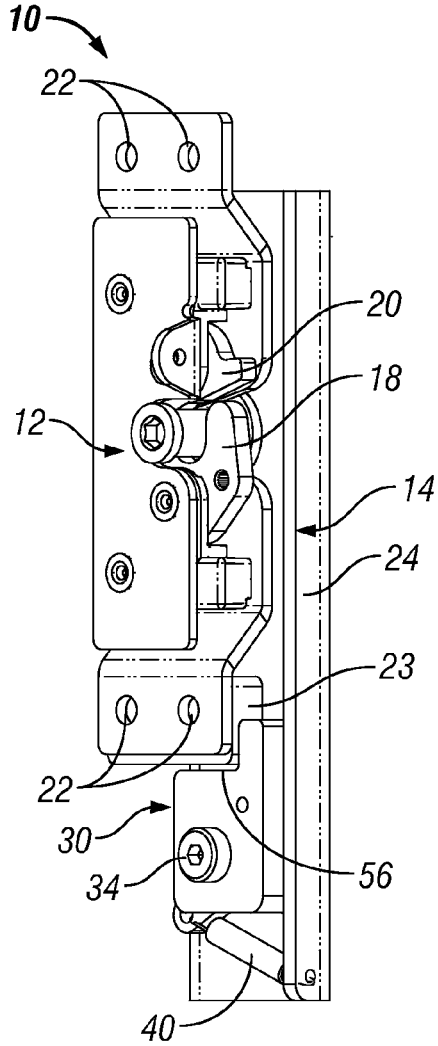
FIG. 4 is a perspective view of the aligned latch and striker assemblies shown in FIG. 3.
Figure 5:
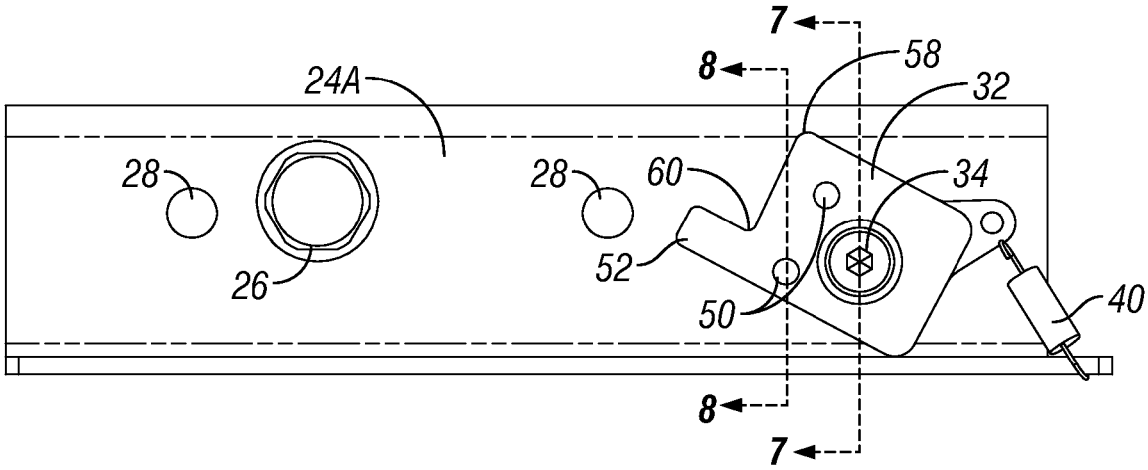
FIG. 5 is a front elevation view showing a striker assembly having the pivotal cam alignment device according to the present invention.
Figure 6:
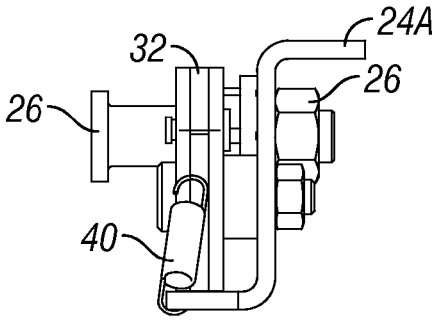
FIG. 6 is an end elevation view of the alignment device mounted on the striker assembly according to the present invention.
Figure 7:
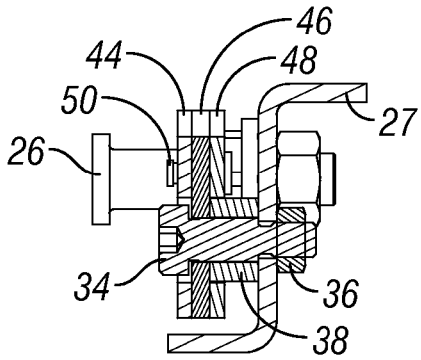
FIG. 7 is a sectional view taken along lines 7-7 of FIG. 5.
Figure 8:
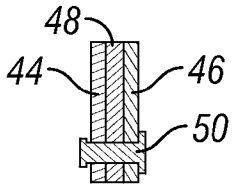
FIG. 8 is a sectional view taken along lines 8-8 of FIG. 5.

The latch assembly 12 includes a housing 16 for pivotally supporting a rotor 18 and catch 20. Mounting holes 22 are provided in the housing 16 to mount the latch assembly 12 to the vehicle door. The latch housing 16 is manufactured from high strength 8 gauge steel and has riveted solid axles to withstand the door weight and vibration loading, so the construction is heavy duty. A replaceable striker block 23 is located at the lower end of the housing, as best seen in FIGS. 2 and 4. The block 23 includes holes aligned with housing holes 22 for receiving a mounting bolt (not shown).

Figure 9:
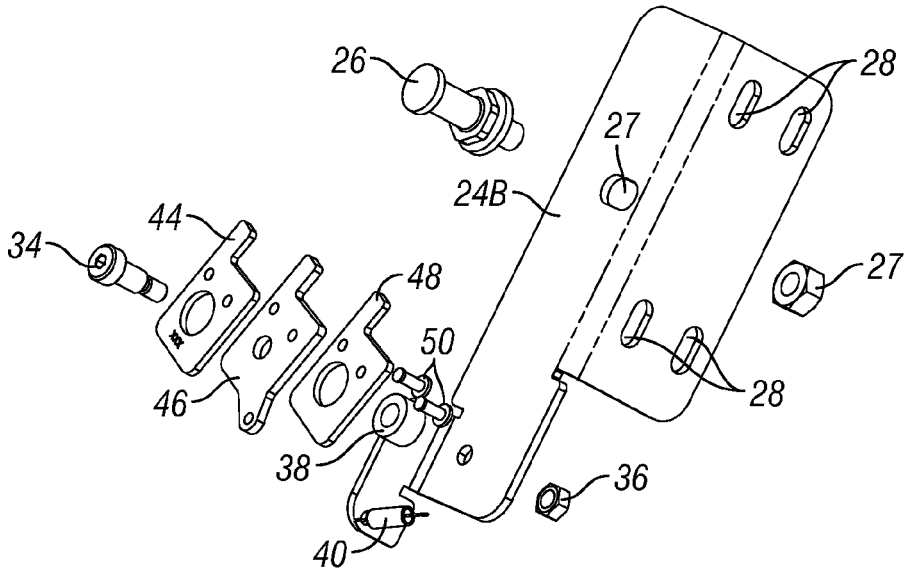
FIG. 9 is an exploded perspective view of an alternative embodiment of a striker assembly having the pivotal cam of the present invention.
Figure 10:
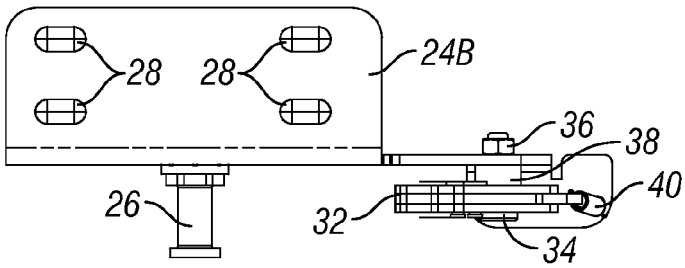
FIG. 10 is a rear elevation view of the striker assembly according to the alternative embodiment of the invention.
Figure 11:
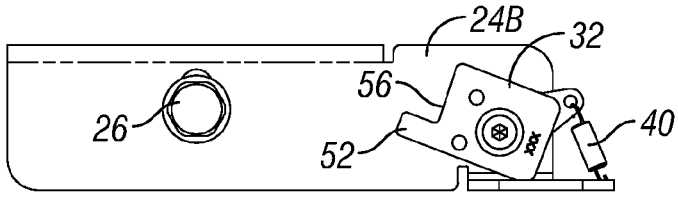
FIG. 11 is a front elevation view of the alternative embodiment.
Figure 12:
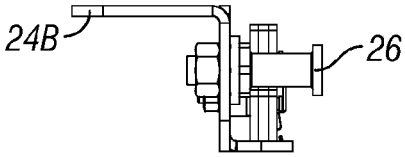
FIG. 12 is an end elevation view of the alternative embodiment.

The striker assembly 14 includes a mounting bracket 24 and a striker bolt or post 26. The bracket 24 has an elongated hole 27 for adjustable mounting of the bolt 26 to the bracket 24, as seen in FIG. 9. The bracket 24 includes mounting holes 28 for mounting the bracket to the vehicle door frame. The holes 28 are elongated to allow adjustability in the mounting of the bracket 24. A first embodiment 24A of the bracket is shown in FIGS. 1-8, while a second embodiment 24B of the bracket is shown in FIGS. 9-12. Bracket 24A is adapted to be mounted on a surface of the door frame which is parallel to the surface of the door to which the latch housing 16 is mounted, whereas the bracket 24B is adapted to be mounted on a surface of the door frame which is perpendicular or transverse to the surface of the door to which the latch housing 16 is mounted. Other than the mounting orientation, the brackets 24A and 24B function similarly to one another.

The present invention is particularly directed towards an alignment device 30 which corrects misalignment between the latch rotor 18 and the striker bolt 26. More particularly, the alignment device 30 includes a cam 32 which is pivotally mounted upon the bracket 24A, 24B of the striker assembly 14. As shown in the drawings, the cam 32 is mounted to the bracket 24A, 24B with use of a bolt 34 and nut 36. However, it is understood that a pin, rivet, or other fastener can be used to mount the cam 32 onto the bracket 24A, 24B for pivotal movement between open and closed positions. A bushing or spacer 38 is provided between the cam 32 and the bracket 24A, 24B to minimize friction during pivotal movement of the cam 32.

The cam 32 is biased to a first or open position when the vehicle door is open. As seen in the drawings, a spring 40 has a first end connected to a tab 42 on the cam 32, and a second end connected to the bracket 24A, 24B. The spring 40 normally urges the cam 32 to the open position shown in FIGS. 1, 2, 5 and 11.

The drawings show the cam 32 to be comprised of multiple plates 44, 46, 48. Multiple plates 44, 46, 48 are used for ease of manufacture, such as by laser cutting, with the plates then being secured together in any convenient manner, such as rivets 50. It is understood that a single plate or duel plates can be used for the cam 32, without departing from the scope of the present invention. The cam 32 also includes an upper finger 52 on one or more of the plates 44, 46, 48.

Figure 3:
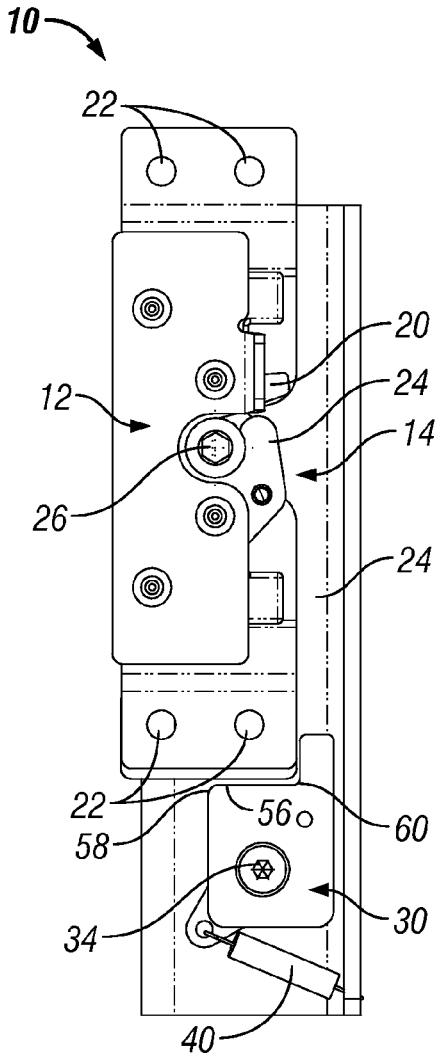
FIG. 3 is an elevation view showing re-alignment of the latch assembly and striker assembly utilizing the alignment assembly of the present invention.

When a misalignment condition exists between the latch assembly 12 and striker assembly 14, as shown in FIGS. 1 and 2, full or complete closure of the vehicle door in the frame becomes difficult, since the striker bolt 26 is not received within the recess or notch 54 of the latch rotor 18. The alignment device 30 functions to correct such misalignment and facilitate proper alignment between the latch assembly 12 and the striker assembly 14 as the door is moved from an open position to a closed position. With reference to FIGS. 1-4, as the door moves toward the door frame, the striker block 23 at the lower end of the housing 16 of the misaligned latch assembly 12 engages the upper surface 56 of the cam 32. As the door continues moving toward the fully closed position, the housing 16 pivots the cam 32 about the offset pivot axis defined by the bolt 34, such that the cam 32 pivots over center, thereby lifting the latch assembly 12 and connected door upwardly into alignment with the striker bolt 26, such that the rotor 18 engages the striker bolt 26 and pivots into its latched position, as seen in FIGS. 3 and 4. In this closed position, the upper surface 56 of the cam 32 supports the latch housing 16. When it is desired to open the vehicle door, the latch assembly 12 is actuated in a conventional manner to open or release the rotor 18. Movement of the vehicle door away from the door frame causes the cam 32 to pivot about the axis of the bolt 34 while allowing the latch housing 16 to slide downwardly along the upper surface 56 of the cam 32, thus preventing a sudden drop of the door as the door returns to the misaligned open position.

The extent or degree of misalignment of the latch assembly 12 relative to the striker assembly 14 determines the point of engagement between the bottom of the housing 16 and the upper surface 56 of the cam 32. The adjustable mounting of the striker bracket 24 and striker bolt 26, via the holes 28 and 27, respectively, allows the misalignment to be minimized. As seen in FIG. 1, a maximum misalignment of approximately 12 millimeters causes the bottom of the housing 16 to engage the upper surface 56 of the cam 32 adjacent a lower corner 58. If the misalignment is less extensive, the housing 16 will engage the upper surface 56 of the cam 32 between the lower corner 58 and the upper corner 60. If the latch assembly 12 and striker assembly 14 are properly aligned when the door is open, the housing 16 will not engage the upper surface 56 of the cam 32 when the door is closed, but will engage the finger 52 of the cam 32 so as to pivot the cam 32 to its closed position.

The pivotal action of the cam 32 and the sloped initial orientation of the upper surface 56 of the cam 32 minimizes the forces required to close the vehicle door when there is a misaligned condition between the latch assembly 12 and the striker assembly 14. It is understood that the alignment device 30 can be provided as original equipment on the striker assembly 14 on new vehicles, or may be retrofit onto the striker assembly 14 of a used vehicle. The alignment device 30 is particularly useful on vehicles having heavy doors, such as military armored vehicles, and other heavy duty applications.

In an alternative embodiment, the pivot cam 32 is mounted on the door frame adjacent the striker mounting bracket 24. For example, clearance issues may require a shorter striker bracket than that shown in the drawings, or the bolt 26 may be mounted to the door frame without a striker bracket. In these types of situations, the cam 32 is mounted to the door frame, but functions in the same manner as described above.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An improved door latch and striker combination for a vehicle door mounted to a door frame, including a latch assembly mounted on the door so as to reside between the frame and the door, the latch assembly having a rotor pivotal between open and closed positions; and a striker assembly mounted on the door frame so as to reside between the frame and the door, the striker assembly having a striker bolt, the improvement comprising:

a pivotal cam on the striker assembly between the frame and the door;

the latch assembly, during closing of the door, engaging and pivoting the cam before the rotor engages the striker bolt so as to lift the door and the latch assembly for alignment of the rotor and striker bolt;

the cam having an upper planar surface which moves during pivotal rotation of the cam between a lowered inclined position when the door is open and a substantially raised horizontal position when the door is closed; and the latch assembly having a striker block adapted to engage the planar surface of the cam to define an area of support when the door is closed.

2. The improved combination of claim 1 further comprising a spring to bias the cam to an initial position when the door is opened.

3. The improved combination of claim 1 wherein the cam supports the door and the latch assembly when the door is being opened.

4. The improved combination of claim 1 wherein the cam supports the latch assembly when the door is closed.

5. The improved combination of claim 1 further comprising a replaceable striker alignment block removably attached to the latch assembly.

6. The improved combination of claim 1 wherein the door has opposite inner and outer sides and an edge extending between the inner and outer sides, and the door frame has an edge facing the door edge, the latch assembly being mounted on the door edge and the striker assembly being mounted on the frame edge.

7. A device aligning a door latch and a striker bolt, the door latch being on a side edge of a vehicle exterior passenger door and the striker bolt being on a side edge of a vehicle door frame, the latch being pivotally mounted on a latch assembly, the device comprising:

a cam pivotally mounted on the door frame, so as to reside between the frame and the door, the cam pivotally moving a between inclined lowered position and a raised generally horizontal positions;

whereby the cam pivotally moves to the raised generally horizontal position when engaged by the latch assembly as the door is being closed, thereby raising the door to align the latch with the striker bolt; and the cam being spring biased toward the lowered inclined position.

8. The device of claim 7 wherein the cam moves to the lowered inclined position so as to lower the door and the latch assembly when the door is being opened.

9. The device of claim 7 wherein the cam supports the latch assembly when the door is closed.

10. The device of claim 7 wherein the cam has an upper planar surface which is movable between the lowered inclined position when the door is open and the raised generally horizontal position when the door is closed.

11. The improved combination of claim 7 further comprising a replaceable striker alignment block removably mounted on the striker assembly.

* * * * *